United States Patent [19]

Browne, Jr.

[11] 4,181,837

[45] Jan. 1, 1980

[54] COMPRESSED-GAS CIRCUIT INTERRUPTER HAVING INSULATED CONTACTS

[75] Inventor: Thomas E. Browne, Jr., Forest Hills Borough, Pa.

[73] Assignee: Westinghouse Electric Corp., Pittsburgh, Pa.

[21] Appl. No.: 884,886

[22] Filed: Mar. 9, 1978

Related U.S. Application Data

[63] Continuation-in-part of Ser. No. 723,280, Sep. 15, 1976, abandoned.

[51] Int. Cl.[2] ..... H01H 33/02

[52] U.S. Cl. ..... 200/148 R; 200/148 A

[58] Field of Search ..... 200/148 R, 148 A

[56] References Cited

U.S. PATENT DOCUMENTS

| | | | |
|---|---|---|---|
| 3,855,437 | 12/1974 | Goedecke et al. | 200/148 R |
| 3,873,792 | 3/1975 | Heiner | 200/148 R |
| 3,891,814 | 6/1975 | Hertz et al. | 200/148 R |

FOREIGN PATENT DOCUMENTS

| | | | |
|---|---|---|---|
| 117076 | 6/1943 | Australia | 200/148 R |
| 450251 | 4/1975 | U.S.S.R. | 200/148 A |

*Primary Examiner*—Robert S. Macon

*Attorney, Agent, or Firm*—L. P. Johns

[57] ABSTRACT

A compressed-gas circuit interrupter characterized by at least one pair of separable contacts, each contact being tubular and having a tubular insulating liner on the inner surface thereof, each liner being recessed from the open end of the contact to provide an unlined tubular surface end portion, each liner having a restrictive cross-sectional area for maximum gas pressure gradient, and gas supply means for directing a flow of compressed gas into the tubular contacts when the contacts are opened to effect elongation and extinction of an arc created upon separation of the contacts.

9 Claims, 7 Drawing Figures

COMPRESSED-GAS CIRCUIT INTERRUPTER HAVING INSULATED CONTACTS

CROSS-REFERENCE TO RELATED APPLICATION

This is a continuation-in-part of application Ser. No. 723,280, filed Sept. 15, 1976, now abandoned.

BACKGROUND OF THE INVENTION

1. Field of the Invention

This invention relates generally to compressed-gas circuit interrupters, and more particularly, to tubular contacts therefor having insulating tubular liners.

2. Description of the Prior Art

A circuit interrupter employing gas blast generally comprises means for establishing an electric arc across a gap between two separating contacts and means for directing a blast of arc extinguishing gas, such as air or $SF_6$, into the arcing zone. The gas serves the function of cooling the arc in order to increase the rate at which its conductance diminishes to zero and subsequently the rate at which the dielectric strength increases across the gap in order to effect complete circuit interruption at current zero.

Associated with the foregoing has been a need for improving the arc interrupting ability as expediently as possible. Various devices have been proposed for that purpose with good results, but further improvement is desirable. Improvement in ability to interrupt short line faults is one important need.

SUMMARY OF THE INVENTION

It has been found in accordance with this invention that improvement of the last mentioned ability may be obtained by providing a compressed-gas circuit interrupter comprising a pair of separable contacts, operating means for moving the contacts between open and closed positions, each contact being tubular and having telescopically fitting end portions with a tubular insulating liner on the inner surface of each contact, each liner being recessed from the open end of the contact to provide an unlined tubular surface end portion adapted for engagement with the other contact, each liner comprising a radially outwardly tapered end portion remote from the other contact, gas supply means for directing a flow of compressed gas into the tubular contacts when the contacts are opened to effect elongation of an arc extending between the unlined tubular end portions, the liners having reduced cross-sections at downstream locations of the gas and from the unlined tubular end portion, and the compressed-gas having a pressure of the order of ten atmospheres, whereby the arc, at least near current zero, is extended in opposite directions within the tubular insulating liners.

The advantage of the device of the invention is that it increases the arc extinguishing ability of the circuit interrupter especially when it is required to interrupt a high current fault in a circuit including a short length of transmission line.

DESCRIPTION OF THE PREFERRED EMBODIMENTS

Figure 1:
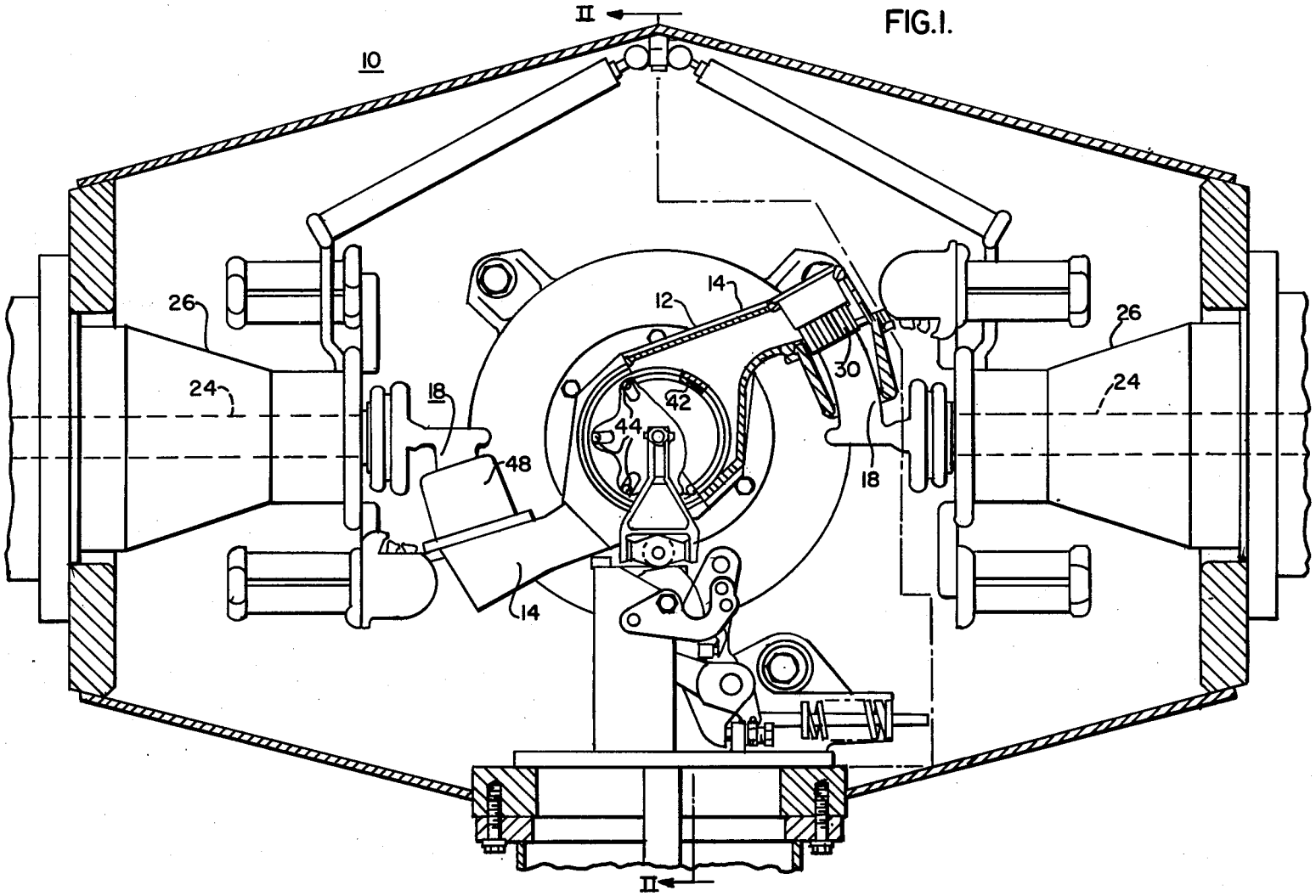
FIG. 1 is a vertical sectional view of an interrupting head of one of the pole units of a compressed-gas circuit interrupter taken on the line I—I of FIG. 2, with the separable contacts shown in the closed circuit position.

In FIG. 1 a compressed gas circuit interrupter is shown having a rotative moving contact arm assembly, such as disclosed in U.S. Pat. Nos. 3,291,947 and 3,327,082, which are incorporated by reference herein. In those patents, a complete description of the mechanism and operation is provided for compressed gas circuit interrupters having a double-rig hollow rotative moving contact-arm assembly, for which reason the description herein is limited to only the essential parts.

Figure 2:
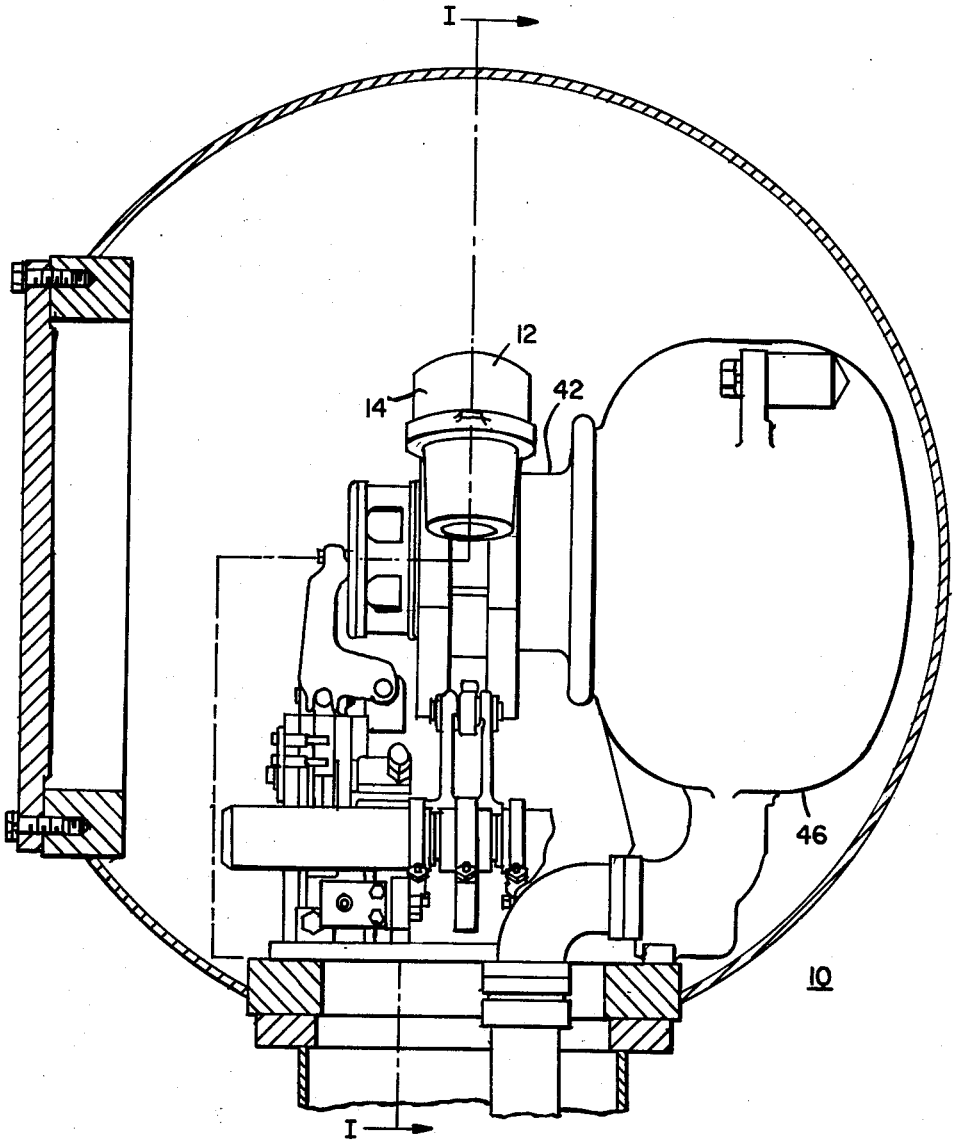
FIG. 2 is a horizontal sectional view taken substantially along the line II—II of FIG. 1 with the resistor and voltage dividing assembly omitted for clarity.

In FIGS. 1 and 2 an interrupting head unit is generally indicated at 10 and it comprises a rotating bridge contact cross-arm assembly 12 which includes a pair of radial outwardly-extending gas conducting arms 14 carrying movable contacts 16. Each movable contact 16 separates from a relatively stationary contact structure 18 to establish an arc 20 (FIG. 3) which is extinguished by an intensive gas flow generally indicated by gas-flow arrows 22. The stationary contacts 18 are supported and clamped to terminal studs 24 extending through terminal bushings 26, the latter protruding through the ends of the interrupting head units 10. Generally, the circuit interrupting structure operates during the opening and closing operations of the contacts to effect rotation of the cross-arm assemblies 12 to consequently bring about a closing, or alternately, an opening of the electrical circuit through the circuit interrupter.

Each movable contact 16 comprises a movable tubular arcing horn 28 (FIG. 3) and a plurality of surrounding circumferentially disposed spring-biased main contact fingers 30. Said fingers 30 conductively engage with the outer sides of the stationary tubular contact structure 18.

During opening of the contacts, the contact fingers 30 are first separated from the outer sides of the tubular main stationary contacts 18 to create the arcs 20 (FIG. 3) between the movable tubular arcing horn 28 and the stationary tubular contact 18. The rotatable cross-arm assembly 12 comprises a pair (one shown) of spaced side plates 31, having journal openings 34 (one shown), respectively, which in conjunction with bearings, rotatably support the cross-arm assembly 12 on an apertured bearing and blast valve support 42. The support 42 is secured by bolts 44 to an auxiliary reservoir tank 46. During the opening operation of the contacts, high pressure arc extinguishing gas, such as sulfur-hexafluoride ($SF_6$) gas, flows as indicated by the gas flow arrows 22 from the tank 46 to the cross-arm assembly 12 to the zone (FIG. 3) of the movable and stationary contacts 16, 18.

In accordance with this invention, it has been found that a more satisfactory extinction of the arc 20 may be obtained by providing a gas pressure of 10 or more atmospheres producing gas flow as indicated by the arrows 22 to extend the arc 20 in opposite directions into the stationary tubular contact 18 and the movable tubular contact 16. Thus, the arc 20, near a current zero moment, includes a pair of loops 21, each extending in the opposite direction. In cases of a short line fault, the rate of circuit voltage recovery just after current zero is so high that the arc may not be extinguished at current zero. In such event arc extinction depends upon an energy balance process just after current zero and the arc interruption is facilitated by an increase in the arc voltage which is obtained by lengthening the arc near current zero. Thus it is more advantageous to work on a long arc column than on a shorter arc.

Figure 3:
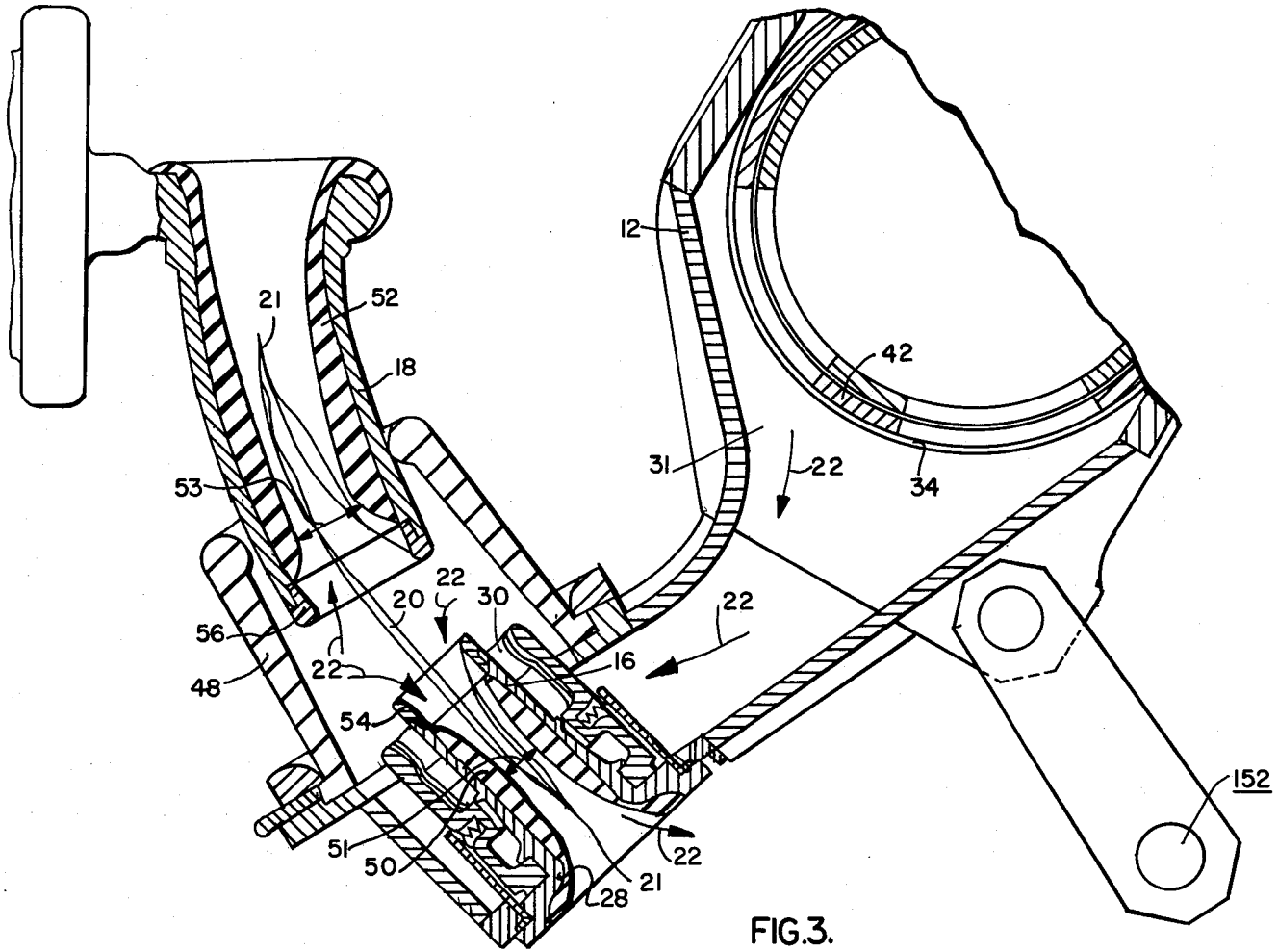
FIG. 3 is an enlarged fragmentary horizontal sectional view, showing the contacts in a partly open position and embodying the principles of the present invention.

To restrict the motion of the arc terminals and so force looping of the arc, each contact 16, 18 is provided with a liner 50, 52 (70 and 72 in FIG. 5), 52 of electrically insulating material, such as polytetrafluoroethylene or other suitable material, which material in non-refractory and also non-carbonizing in the combined blast of the gas and arc. In the closed position of the contacts 16, 18 the movable contact 16 is preferably telescopically disposed within the end of the stationary contact 18. To protect the ends of the contacts, inserts 54, 56 are preferably provided at the engaging portions of the telescoping contacts. The inserts 54, 56 are preferably comprised an arc erosion resistant material, such as a matrix of tungsten and silver or the like. As shown in FIG. 3 the ends of the liners 50, 52 are preferably receded from the ends of the corresponding contacts 16, 18 and extend toward the opposite ends thereof with a radially tapering or flared configuration to enable supersonic gas flow through the contacts 16, 18. By providing the contacts 16, 18 with liners 50, 52, which are recessed from the operating ends thereof, each contact includes an exposed or unlined portion where opposite ends of the arc 20 are stationed and preferably remain until extinguished. It is preferred to have such a portion for limiting the terminals of the arc 20 and thereby enable their movement into engagement when closed in the telescopically fitting position. However, the remaining interior surfaces of the contacts 16, 18 are covered with liners 50, 52 which in combination with the high pressure of the gas ($SF_6$) are conducive to arcs of increasing length as compared with tubular structures of prior construction.

More particularly, in accordance with this invention, the insulating liners 50, 52 having the radially tapered or flared configuration, comprise smaller diameters or reduced cross-sections 51, 53. Each cross-section 51, 53 is the smallest cross-section of the gas flow channel of the corresponding liner and is downstream of its corresponding inserts 54, 56. As the gas 22 enters each contact 16, 18, it elongates the initial arc 20 into the pairs of arc loops 21. Each loop 21 extends downstream of the inserts 54, 56 and through the reduced or constrictive cross-sections 51, 53 where maximum gas pressure and velocity-gradients are incurred in accordance with the Bernoulli principle. Thus, optimum conditions for arc extinction prevail in the cross-sections 51, 53 and the arc loops 21 are forced against the insulating non-refractory nozzle liner, rather than against a metal surface as in prior art structures.

Figure 4:
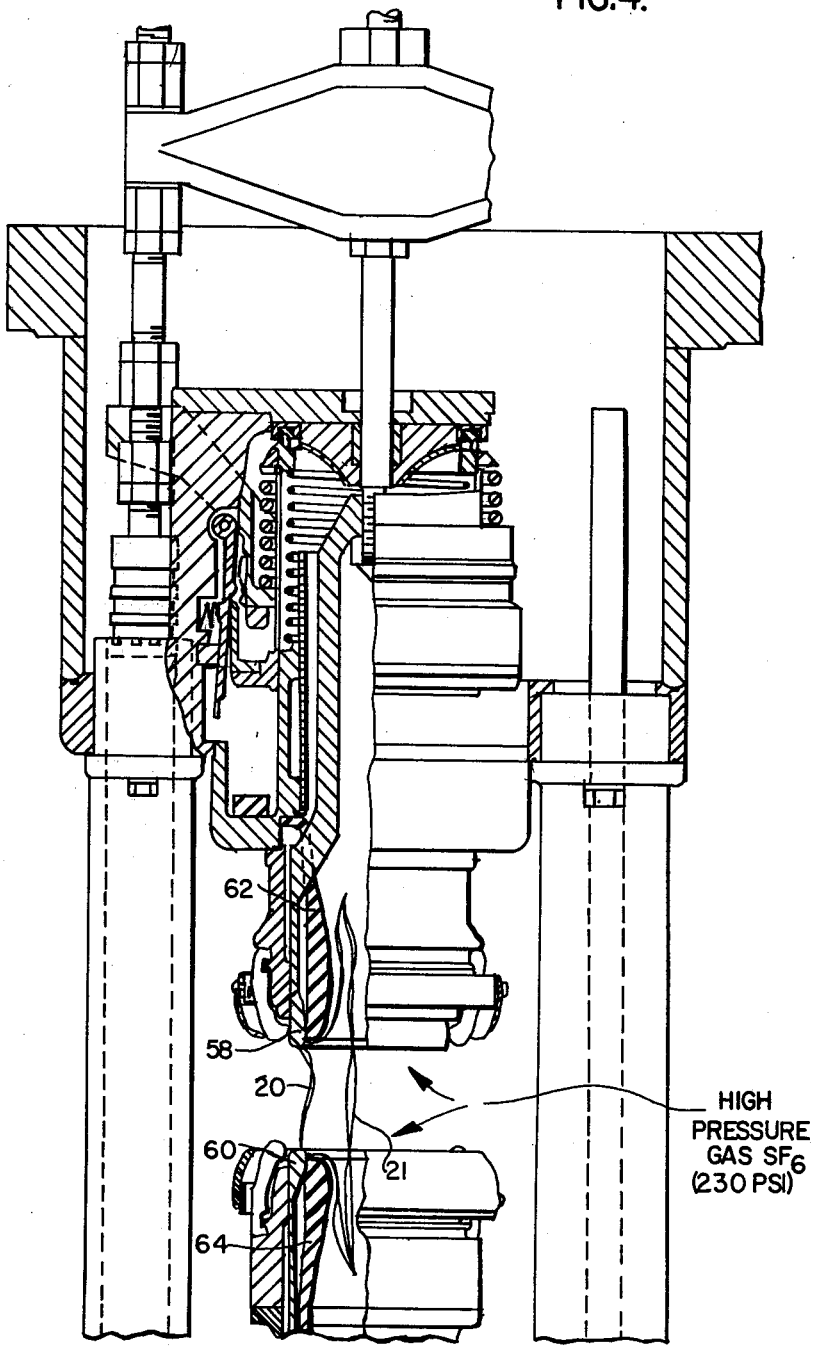
FIG. 4 is a vertical sectional view of a portion of a contact structure of a circuit breaker of another embodiment.

Another embodiment of the invention is shown in FIG. 4 which discloses a contact structure for a circuit breaker, such as disclosed in U.S. Pat. No. 3,639,719. Inasmuch as the construction and operation of the circuit breaker shown in FIG. 4 is completely disclosed in that patent, which is incorporated by reference herein, only a limited description is set forth herein. Suffice it to say, the circuit interrupter of FIG. 4 provides a pair of tubular electrodes comprising movable electrode 58 and stationary electrode 60, which electrodes are separable by longitudinal movement of the movable electrode 58 to an upper position as shown in FIG. 4. The electrodes 58, 60 are provided with tubular liners 62, 64, respectively, which are substantially coextensive with the inner surfaces of the contacts. In the closed position, the contact 58 fits telescopically around the upper end portion of the stationary contact 60 and is in electrical engagement therewith. As in the embodiments of the liners 50, 52 (FIG. 3) the liners 60, 64 are preferably recessed from the ends of the contacts 58, 60 to better maintain the ends of the arc 20 in those locations until it is extinguished. In addition, the liners 62, 64 are tapered, or flared, radially outwardly from the contacting ends of the contacts to the opposite ends thereof. As a result, when the contacts 58, 60 are opened, an initial arc 20 forms which immediately expands into the elongated form of the arc 21 as high pressure gas surrounding the electrode assembly moves into and through the hollow electrode assemblies, thereby greatly extending, cooling, and speeding the dielectric recovery of the arc 21.

Figure 5:
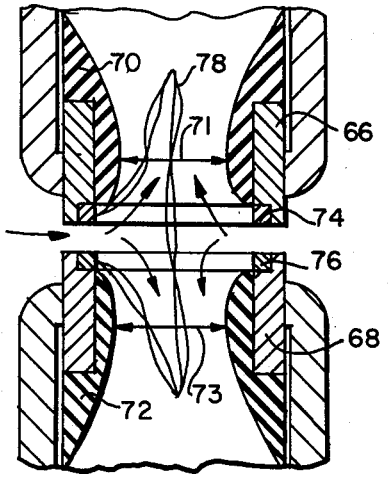
FIG. 5 is a vertical sectional view of a pair of spaced contacts showing schematically another embodiment of the invention similar in principle to that of FIG. 4, but simplified for clarity.

In an illustrative embodiment of the invention, as shown in FIG. 5, a pair of the contacts 66, 68 are similarly provided with corresponding liners 70, 72, comprising materials similar to that of the liners 50, 52, 62, 64. The contacts 66, 68 differ from those of the prior embodiment in that they are of similar diameter and are in end-to-end abutment in the closed positions. Moreover, the ends of the inserts 70, 72 are recessed from the abutting ends of the contacts and extend in opposite directions in radially outwardly or tapered directions similar to the liners of the prior embodiments. Annular insert 74 and 76 or arc abrasive resistant material, such as a matrix of silver-tongsten, may be provided in recessed sections of the abutting ends of the contacts 66, 68. When the contacts 66, 68 separate to the open position (FIG. 5), compressed gas enters the opening created therein and immediately moves in opposite direction through the contacts 66, 68 to extend the length of an arc 78 in a manner similar to that set forth in the prior embodiments.

Figure 6:
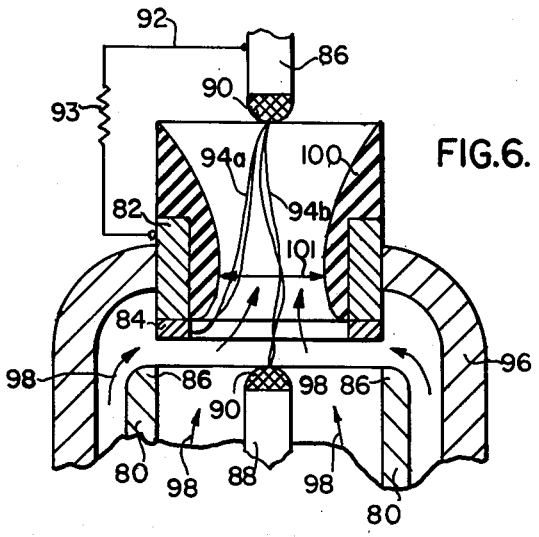
FIG. 6 is a vertical section of a pair of spaced contacts showing schematically in simplified form an embodiment similar to that of a variation of FIG. 4 in which only one of the contacts is in the form of a nozzle, a form known as a single flow gas-blast interrupter.

FIG. 6 discloses another embodiment in which finger contacts 80 are provided in open position with respect to a cylindrical contact 82, the latter of which is similar to the contact 66 of FIG. 5. Thus the contact 82 comprises an annular insert 84 which functions with inserts 86 of the finger contacts 80. In addition, the embodiment of FIG. 6 may include a pair of arc catchers 86, 88 having similar inserts 90 which, like the inserts 84, 86 are comprised of arc abrasive resistant material, such as a matrix of silver-tungsten. A shunt resistor circuit 92 is provided between the arc catcher 86 and the contact 82. Thus, when the contacts are separated, an arc 94 extends as shown between the arc catchers 86, 88. Associated with the finger contacts 80 is a tubular gas flow guide 96, the upper end of which is in snug fitting contact with the annular contact 82 in order to direct a gas blast as indicated by the arrows 98 into the zone of the arc 94. In each of the embodiments of FIGS. 5 and 6 the orifice and contact details are shown schematically and the arcs 78, 94 are shown in extended positions which are achieved near current zero by action of the gas blast. Near current peak such arc extension is impossible because of the tendency for the two sides of the arc loop to merge so as to "short out" most of the loop when the current and the column diameter are relatively large. This limitation also minimizes the arc voltage and hence the arc power loss during the high current portions of the cycle, thus minimizing the destructive tendency of the arc. Insulating liners 70, 72, and 100 like those of the other embodiment of this invention, are preferably of non-refractory material, but are also effectively non-carbonizing in the gas blast. With $SF_6$ as the gas medium, polytetrafluoroethylene is the preferred liner material. With compressed air as the gas medium, a hard fiber or synthetic plastic such as polymethyl methacrylate also provides satisfactory results as a liner. The arc catchers 86, 88 with or without the shunting circuit 92 may be used if desired with any of the orifice arrangements illustrated, such as in the embodiment of FIG. 5. In FIG. 6 the function of the resistor 93 in the circuit 92 is to reduce the rate of rise of restored voltage (RRRV) across the left-hand portion 94*a* of the arc 94. This reduction caused the arc portion 94*a* to be extinguished first, thus transferring the current intially carried by it into the shunt circuit 92. This current, which is reduced in magnitude and shifted in phase by the resistor 93, is then easily interrupted by the central branch 94*b* of the arc 94, thus finally interrupting the circuit.

Figure 7:
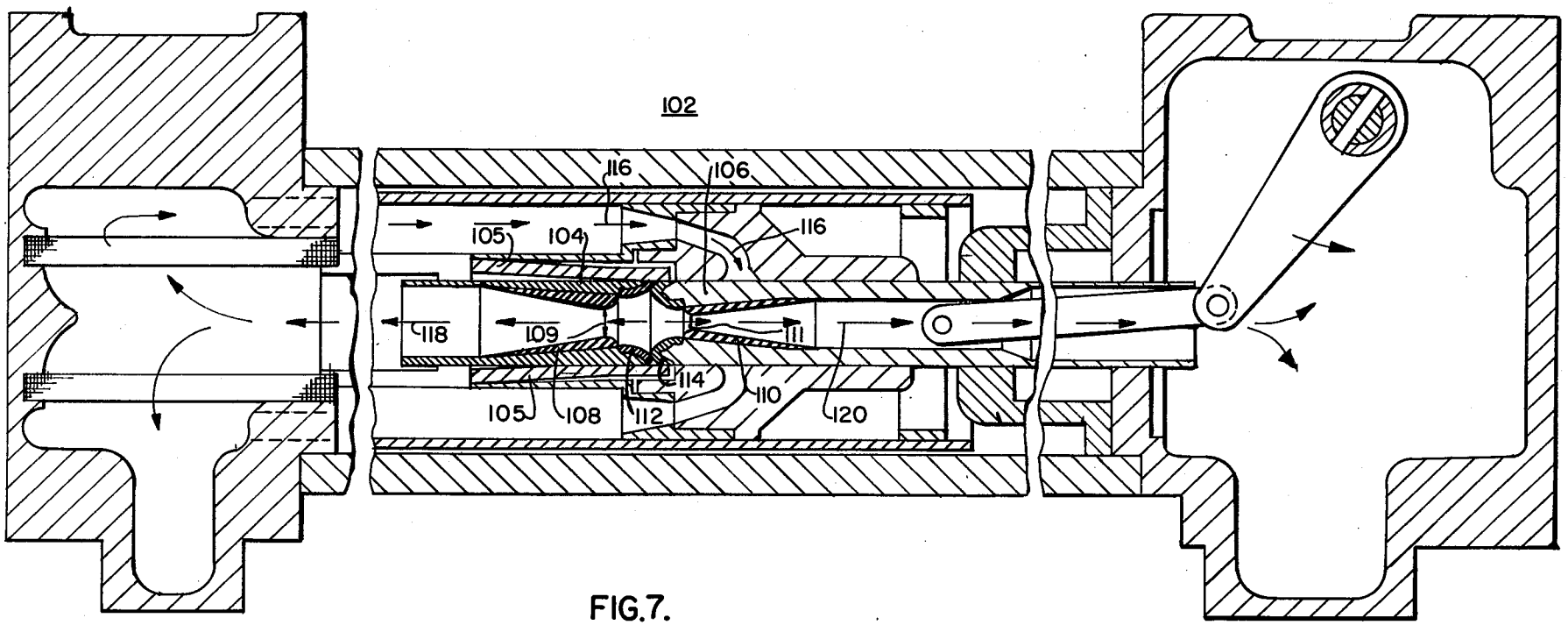
FIG. 7 is a vertical sectional view of a so-called "puffer" type of circuit interrupter embodying the principles of this invention.

Finally, another embodiment of the invention is shown in FIG. 7 which discloses a gas blast circuit interrupter 102 generally of the type disclosed in U.S. Pat. No. 3,814,883, entitled "Delayed-Blast Fluid-Flow Circuit Interrupter," which is the invention of Russell E. Frink and Stanislaw A. Milianowicz. Inasmuch as a complete description and operation of this so-called "puffer" type of gas circuit interrupter is provided in U.S. Pat. No. 3,814,883, the description herein is limited only to the essential parts.

In FIG. 7 a stationary tubular contact 104 is in end-to-end abutment with a movable tubular contact 106. Similar to the contact structure in FIG. 3 the tubular contact 104 comprises a plurality of spaced contact fingers 105 surrounding the contact 114 in the closed position. Each contact 104, 106 includes an annular inner liner 108, 110. In addition, each contact 104, 106 is preferably provided with inserts 112, 114, respectively, at abutting ends thereof for, like the inserts, of the prior embodiments, the inserts 108, 110, are recessed from the abutting ends of the tubular contacts 104, 106 and extend in opposite directions therefrom in a generally tapering manner as set forth above. When the contacts 104, 106 are separated from the closed position (as shown) a gas blast is directed between the separating contacts as indicated by the arrows 116 and then in opposite directions through the tubular contacts as indicated by the arrows 118, 120.

Like the liners 50, 52 (FIG. 3) 62, 64 (FIG. 4), the liners 70, 72, 100, 109, and 111 (FIGS. 5, 6, and 7) comprise thickened portions that provide zones of reduced cross-sections or restricted areas 71, 73, 101, 109, 111 or smaller diameters than the sections ahead or behind them. As a result when an arc-extinguishing gas moves through the several liners, it moves at a greater velocity and pressure gradient to cause arc loops in those zones to be puffed out or extinguished more effectively than in prior structures. Moreover, the relative locations of those zones; i.e. downstream from the respective inserts where the arcs originate, enhance the arc extinguishing character of the overall structure.

In conclusion, the particular contact construction of this invention provides for rapid lengthening of an arc near current zero so that the arc voltage is sufficiently high to accomplish the energy balance limited interruption of the arc.

What is claimed is:

1. A compressed-gas circuit interrupter comprising a first pair of separable contacts, operating means for moving the contacts between open and closed positions, each contact being tubular and having an electrically conducting insert comprised of arc erosion-resistant material at the upstream open end thereof, a tubular electrically insulating liner on the inner surface thereof, the inserts of both contacts being in electrical contact in the closed position, each liner being recessed from the open end of the contact to provide an unlined tubular surface end portion, each liner having a tubular zone of reduced diameter downstream of the gas flow from said insert, the tubular zone of reduced diameter being smaller than the diameter of the insert, the tubular zone being within an electrically insulating material, and gas supply means for directing a flow of compressed gas into the tubular contacts when the contacts are opened to effect elongation of an arc extending between the unlined tubular surface end portions, whereby the arc is extended in opposite directions within the tubular insulating liners.

2. The compressed-gas circuit interrupter of claim 1 in which each liner comprises a radially outwardly tapered end portion remote from the liner end recessed from the end of the contact.

3. The compressed-gas circuit interrupter of claim 2 in which the compressed-gas has a pressure of the order of 10 atmospheres.

4. The compressed gas circuit interrupter of claim 2 in which the gas supply means comprises a gas-reservoir tank and a gas conduit, a second pair of contacts, a rotatable bridging contact cross-arm assembly carrying the movable contacts and rotatively supported on the conduit and being separable from the stationary contacts to establish an arc, valve means movable with respect to the conduit to an open position for controlling a flow of high pressure gas through the conduit from the tank, and means for driving the bridge contact cross-arm assembly and the movable contacts.

5. The compressed-gas circuit interrupter of claim 4 in which the unlined tubular end portions of each pair of contacts are telescopically disposed when in the closed position.

6. The compressed-gas circuit interrupter of claim 5 in which the movable contacts are telescopically disposed within the stationary contacts.

7. The compressed-gas circuit interrupter of claim 3 in which there are means for mounting the movable contact for movement on the longitudinal axis of the contacts, and the gas supply means comprising a container about the separable contacts.

8. The compressed-gas circuit interrupter of claim 2 in which one tubular contact is movable and fits telescopically around the end portion of the other contact in the closed position.

9. The compressed-gas circuit interrupter of claim 3 in which one tubular contact comprises a plurality of spaced finger contacts which are peripherally disposed around the one contact and surround the other contact in the contact-closed position.

* * * * *